United States Patent [19]

Crosby

[11] 3,969,793

[45] July 20, 1976

[54] SPRING CONSTRUCTION

[75] Inventor: Lawton H. Crosby, Lake Bluff, Ill.

[73] Assignee: Morley Furniture Spring Corporation, Chicago, Ill.

[22] Filed: June 17, 1975

[21] Appl. No.: 587,717

Related U.S. Application Data

[63] Continuation of Ser. No. 415,940, Nov. 15, 1973, abandoned, which is a continuation of Ser. No. 185,196, Sept. 30, 1971, Pat. No. 3,773,310.

[52] U.S. Cl. ..... 24/84 B; 5/259 B; 267/110

[51] Int. Cl.[2] ..... A44B 21/00; F16F 3/02; A47C 23/02

[58] Field of Search ..... 5/259 B, 259 R; 24/259 SP, 255 TC, 255 AS, 73 SS, 84 B; 248/226 E, 227, 226 A, 226 R; 267/110, 87

[56] References Cited

UNITED STATES PATENTS

| | | | |
|---|---|---|---|
| 1,746,942 | 2/1930 | Hise | 5/259 B |
| 2,652,885 | 9/1953 | Engel | 24/73 SS X |
| 2,685,330 | 8/1954 | Handren et al. | 5/259 B X |
| 3,288,503 | 11/1966 | Slominski | 267/110 X |
| 3,389,438 | 6/1968 | Haynes | 24/84 B |
| 3,836,106 | 9/1974 | Gray | 248/226 E X |

*Primary Examiner*—Donald A. Griffin
*Attorney, Agent, or Firm*—Hume, Clement, Brinks, Willian, Olds & Cook, Ltd.

[57] ABSTRACT

An attachment clip and assembly for attaching the end of a sinuous spring band to a wood furniture frame rail without the need for any nails or staples whatever and without any hammering or driving to engage the anchoring tangs. The clip has an anchor leg and an attachment leg. Tiny, sharp, upwardly inclined anchor saw-teeth plow in against the outer surface of the rail and automatically embed in the surface when pressure is applied by the spring band secured to a hook on the free end of the attachment leg. Anti-backoff means in the form of anti-backoff feet bearing against the inner surface of the rail and/or outwardly inclined anti-backoff tangs under the attachment leg serve to prevent the clip from becoming unseated when spring tension is released and outward shock loading applied to the clip.

9 Claims, 6 Drawing Figures

SPRING CONSTRUCTION

FIELD OF THE INVENTION

This application is a continuation of application Ser. No. 415,940, filed Nov. 15, 1973 and now abandoned, the latter, in turn, being a continuation application Ser. No. 185,196, filed Sept. 30, 1971, for SPRING CONSTRUCTION and now U.S. Pat. No. 3,773,310 issued Nov. 20, 1973. The invention is in the field of spring assemblies. It relates particularly to furniture spring assemblies of the type employing sinuous spring bands.

BACKGROUND OF THE INVENTION

The aforementioned application discloses a major improvement in spring band attachment clips and assemblies. The present invention is related to that improvement and constitutes a further major advance in the art.

Heretofore, it has been necessary with all top rail attachment clips to either (1) drive nails or staples into the wood frame rail to fasten the clips to the rail, or (2) drive the clip itself into the rail. The latter type of clip is disclosed in several forms in the aforementioned applications and is a marked improvement over the former. In either case, however, labor is required to seat and drive in the nails, staples or the clip itself, although with my earlier invention the cost of nailing or stapling is eliminated.

SUMMARY OF THE INVENTION

An object of the present invention is to provide an improved attachment clip which firmly anchors itself automatically on the rail. Another object is to provide an attachment clip which does not require supplemental nails or staples or costly labor to seat these nails or staples. Still another object is to provide an attachment clip which will not itself back off from a rail if spring band tension is suddenly released, nor allow the spring band end to disengage from the clip. It is yet another object to provide an attachment clip which is simple and inexpensive to fabricate.

The foregoing and other objects are realized in accord with the present invention by providing an attachment clip including an anchor leg and an attachment leg. The anchor leg seats against the outer surface of a wood frame rail on a plurality of sharply pointed tiny tangs or saw-teeth extending upwardly at a 45° angle to the vertical. The tangs are only approximately one-eighth inch long. They are very short so they will not sink completely into the rail but, rather, embed in the outer surface only slightly under normal conditions. In this light, they should not be longer than approximately three-sixteenths inches. With the tension of a spring band on the clip forcing these tangs into engagement with the surface, it will be seen that there is no way the clip can slide upwardly on the outer surface and off the frame, as the more the clip might seek to ride up, the more the tiny multiple tangs plow themselves in.

To prevent shock loads on the sinuous spring bands from momentarily urging the clip away from the frame rail, anti-backoff means are provided. With conventional, vertical rail frames, these anti-backoff means preferrably take the form of depending, anti-backoff feet which engage the inner surface of the wood frame rail with the clip properly seated in operational relationship on the rail. In the case of horizontal wood frame rails, outward-looking anti-backoff tangs on the attachment leg are provided. These anti-backoff tangs do not sink completely into the upper surface of the rail but, like the aforedescribed anchor leg tangs, embed only slightly in the upper surface. However, they are inclined outward toward the outer surface of the rail at an angle of 45° to the horizontal and serve to prevent outward movement of the clip under any shock load condition normally encountered.

BRIEF DESCRIPTION OF THE DRAWING

The invention, including additional objects and advantages thereof, is illustrated more or less diagrammatically in the drawing, in which.

DESCRIPTION OF THE PREFERRED EMBODIMENTS

Figure 1:
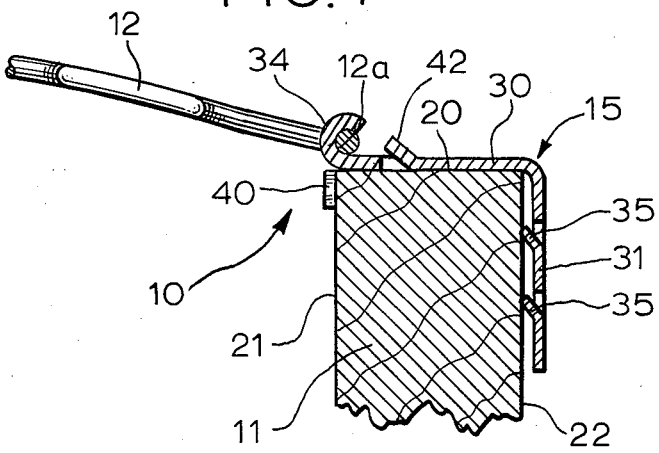
FIG. 1 is a sectional view through the back rail of a conventional, vertical rail furniture seat frame, illustrating a regular end sinuous spring band attached to the rail by means of an attachment clip and attachment assembly embodying features of a first form of the present invention.

Referring now to the drawing, and particularly to FIG. 1, a portion of a furniture spring assembly is illustrated generally at 10. The furniture spring assembly 10 includes a conventional frame having a vertical wood frame rail 11, in this case either the back or front rail. A conventional, regular loop, regular end, sinuous spring band 12 is attached to the rail 11 by an attachment clip 15 embodying features of a first form of the invention.

The wood rail 11 of the furniture spring assembly 10 has a flat horizontal upper surface 20, a flat vertical inner surface 21, and a flat vertical outer surface 22. The attachment clip 15 includes an attachment leg 30 seated flush against the upper surface 20 and an anchor leg 21 seated against the outer surface 22 of the rail. An open mouth C-hook 34 is formed at the front, or free end of the attachment leg 30 and the ultimate linear segment **12*a* of the sinuous spring band 12 is seated in the C-hook 34 to connect the band to the clip 15 and, accordingly, to the rail 11**.

Figure 2:
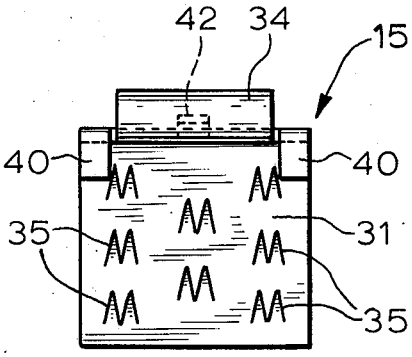
FIG. 2 is a front elevational view of the clip illustrated in FIG. 1, with the spring band and rail removed.

The anchor leg 31 of the clip 15 has a plurality of anchor tangs 35 formed inwardly from it by conventional forming techniques. The anchor tangs 35 are each double-tooth saw-tooth tangs, as best illustrated in FIG. 2, and are formed inwardly at an angle of 45° to the vertical, as best illustrated in FIG. 1. The tangs 35 are only approximately one-eighth inch long, and have sharp needle points.

The anchor tangs 35 are arranged in diagonal rows extending upwardly and to the right in FIG. 2. As a result, no three anchor tangs are aligned on any horizontal line across the width of the anchor leg 31. The purpose of this arrangement is to avoid closely spaced tangs seated against the outer surface 22 of the rail 11 along the normally horizontal grain line of the wood rail. This is a precaution against splitting the wood rail 11. As seen in FIG. 2, in the clip 15, two diagonal rows of three tangs 35 each are provided, bracketed by a tang 35 in the lower righthand corner and a tang 35 in the upper lefthand corner of the anchor leg 31.

With the attachment clip 15 properly seated on the frame rail 11, as illustrated in FIG. 1, the tips of the tangs 35 are embedded only slightly into the outer surface 22 of the rail. At the same time, anti-backoff feet 40 bracketing the C-hook 34 and formed downwardly, perpendicular to the attachment leg 30, are seated flush against the front surface 21 of the rail 11. They prevent the clip 15 from moving rearwardly on the upper surface 20 of the rail 11 and causing the anchor tangs 35 to lose their effectiveness in preventing the anchor leg 31 from riding up on the outer surface 22 on the rail.

The ultimate linear segment 12*a* of the spring band 12 is retained in the mouth of the C-hook 34 by positive anti-popout tab 42. The anti-popout tab 42 is formed upwardly from approximately the center of the attachment leg 30 to a point where its free end leaves an opening with the free end of the C-hook 34 which is only slightly larger than the diameter of the wire in the band 12, specifically the ultimate linear segment 12*a*. As a result, when the ultimate linear segment 12*a* is passed through the opening left between the anti-popout tab 42 and the free end of the C-hook 34, it cannot readily pop out of this opening if the band is subjected to shock load and seeks to move rearwardly. This anti-popout tab design presents a flush butt positive stop to the spring end, rather than a non-positive ramp juncture.

When the band 12 is subjected to such shock load, however, it may engage the tab 42 and, accordingly, tend to urge the clip 15 rearwardly on the rail 11. The anti-backoff feet 40 prevent this from happening.

The clip 15 is easily mounted on the rail 11 by hand-pressing it downwardly over the rail with the feet 40 engaging the front surface 21. The anchor tangs 35, because of their upward inclination, ride easily downwardly over the rail's outer surface 22 until the attachment leg 30 of the clip is seated snugly against the upper surface 20 of the rail 11. When the sinuous spring band 12 is sprung into position, as illustrated in FIG. 1, the tangs 35 embed slightly and the clip 15 is locked into the rail 11. No staples or nails are required. Furthermore, the clip 15 requires no hammering to be seated into place and no hammering or driving of the tangs to cause them to engage.

The advantages of the clip 15 and the band 12 attachment assembly which it forms the backbone of are now readily discerned. Labor, materials and time formerly required to seat attachment clips are eliminated. Because the clip 15 can be properly seated without tools, it can be used in otherwise difficult areas to reach; under a back stuffing rail, for example. Nevertheless, it cannot inadvertently pop-off the rail.

Figure 3:
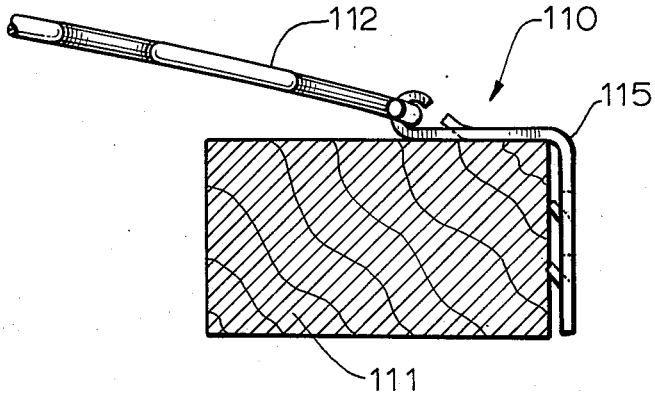
FIG. 3 is a view similar to FIG. 1, illustrating a second form of the clip and attachment assembly embodying features of the invention, as mounted on a conventional horizontal rail.

Referring now to FIG. 3, a furniture spring assembly 110 includes a horizontal back rail 111 and a conventional sinuous spring band 112 is illustrated. The band 112 is connected to the rail 111 by an attachment clip 115 embodying features of the second form of the invention. The clip 115 is specifically adapted for a spring band attachment assembly in horizontal rail furniture. In this regard, the clip 115 is identical to the clip 15 hereinbefore discussed with the exception that anti-popoff feet (40) are eliminated.

Obviously, the specific advantages provided by anti-popoff feet are not found in this form of the invention. However, the numerous other features of the invention remain. As will be seen in the fourth form of the invention hereinafter discussed, it is possible, according to the invention, to provide alternative anti-popoff means.

Figure 4:
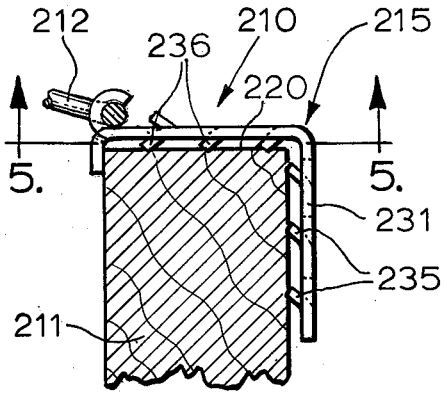
FIG. 4 is also a view similar to FIG. 1, illustrating a third form of the attachment clip and attachment assembly embodying features of the present invention.
Figure 5:
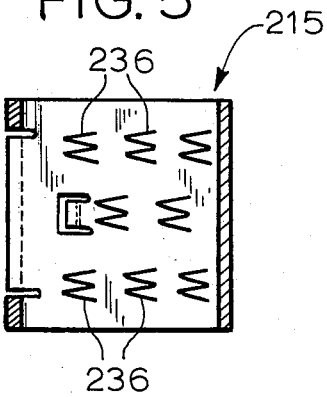
FIG. 5 is a sectional view taken along line 5—5 of FIG. 4.

FIGS. 4 and 5 illustrate a third form of the invention. There a spring assembly 210 is illustrated. A vertical back rail 211 is shown joined to a conventional sinuous spring band 212 by an attachment clip 215 embodying features of the invention.

The attachment clip 215 and its related attachment assembly are identical to the first form of the invention, with one exception. An arrangement of anchor tangs 236 identical to the anchor tangs 235 on the anchor leg 231 is provided under the attachment leg 230 as well.

The anchor tangs 236 are arranged in the same staggered pattern as the anchor tang 235; i.e., in the pattern illustrated in FIG. 2 with relation to the clip 15. This arrangement of anchor tangs 236, inclined inwardly at an angle of 45° to the horizontal and each approximately one-eighth inch long, provides additional anchoring force. The normal inward and downward vectored force created by the spring band 212 attempting to draw its free ends inwardly and downwardly, serves to force the anchor tangs 236 into the upper surface 220 of the rail 211. Thus, the clip 215 has all of the advantages of the clip 15 hereinbefore described with the additional advantage of further anchoring force.

Figure 6:
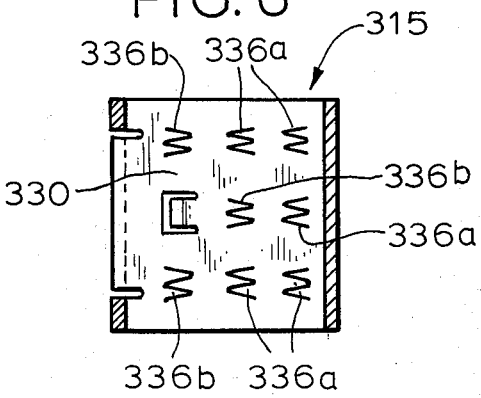
FIG. 6 is a view similar to FIG. 5, illustrating yet a fourth form of the clip embodying features of the invention, which clip is a slightly modified version of the third form illustrated in FIGS. 4 and 5; i.e., bi-directional orientation of the tangs on the attachment leg, both inward and outward.

FIG. 6 illustrates a fourth form of the invention. It discloses an attachment clip 315 which is virtually identical to the anchor clip 215 immediately before herein described, except that the anchor tangs on the attachment leg 330 of the clip are divided between anchor tangs 336*a* and anti-backoff tangs 336*b*. The anti-backoff tangs 336*b* are inclined outwardly of the clip, opposed to the inward inclination of the anchor tangs 336*a* at an angle of 45° to the horizontal. They tend to prevent rearward movement of the clip on the rail surface 20 when the spring tension is released or rearward shock loading applied to the clip.

It has not been shown, but anti-backoff tangs such as the tangs 336*a* can also be employed in clip construction similar to the clip 115 used on horizontal rails. An anti-backoff capability would thus be provided where anti-backoff feet could not be utilized.

The invention has been described in terms of its use on a back rail. It is equally applicable to front rail spring attachment, however. Regardless of which rail it is applied to, the C-hook in which the last linear segment of the spring band is seated is positioned on the top edge of the frame rail so that the wire segment is disposed in back of or at least substantially in back of the vertical plane of the corresponding surface of the rail.

While several embodiments described herein are at present considered to be preferred, it is understood that various modifications and improvements may be made therein, and it is intended to cover in the appended claims all such modifications and improvements as fall within the true spirit and scope of the invention.

What is desired to be claimed and secured by Letters Patent of the United States is:

1. A rail attachment arrangement for attaching a sinuous spring band to a frame rail, comprising:

a. an attachment clip, b. said rail having vertical inner and outer surfaces and a horizontal top surface, c. said attachment clip including an anchor leg seated on said outer surface and an attachment leg seated on said top surface, d. said attachment leg having hook means formed thereon and a linear wire segment of the spring band being seated in said hook means for connecting the end of said band to said clip, e. said hook means being positioned on said top surface so that said linear wire segment is disposed at least substantially in back of the plane of said inner surface, f. said spring band normally being effective to draw said anchor leg against said outer rail surface and, at the same time, tending to draw it upwardly on said surface, g. a plurality of anchor tangs formed inwardly from said anchor leg and being inclined upwardly from the horizontal whereby when forced against said outer rail surface by spring band force they bite into the wood and prevent upward movement of said clip on said rail, h. and anti-backoff means on said attachment leg for preventing outward movement of said clip on said rail, i. said anti-backoff means comprising foot means depending from the free end of said attachment leg and bearing against the inner surface of said rail to prevent rearward movement of said clip on said rail.

2. The rail attachment assembly of claim 1 further characterized in that:

a. said tangs are inclined upwardly at an angle of approximately 45° to the vertical.

3. The rail attachment assembly of claim 2 further characterized in that:

a. said tangs are approximately one-eighth inch long.

4. The rail attachment assembly of claim 2 further characterized in that:

a. said tangs are no more than three-sixteenths inch long.

5. The rail attachment assembly of claim 1 further characterized in that:

a. said anchor tangs are arranged so that three vertical rows of tangs are provided, b. no three of said tangs in separate rows being in the same horizontal plane parallel to the wood grain.

6. The rail attachment assembly of claim 1 further characterized in that:

a. said anchor tangs are each double-tooth tangs.

7. The rail attachment assembly of claim 1 further characterized in that:

a. a plurality of anchor tangs are formed downwardly from said attachment leg, b. said attachment leg anchor tangs being inclined forwardly from the vertical whereby when forced against said top surface by spring band force they prevent forward movement of said clip on said rail.

8. The rail attachment assembly of claim 7 further characterized in that:

a. said attachment leg anchor tangs are inclined forwardly at an angle of approximately 45° to the vertical.

9. The rail attachment assembly of claim 1 further characterized by and including:

a. anti-backoff means on said attachment leg for preventing outward movement of said clip on said rail.

* * * * *

UNITED STATES PATENT AND TRADEMARK OFFICE

CERTIFICATE OF CORRECTION

PATENT NO. : 3,969,793

DATED : July 20, 1976

INVENTOR(S) : Lawton H. Crosby

It is certified that error appears in the above-identified patent and that said Letters Patent are hereby corrected as shown below:

Column 1, line 5, after "continuation" insert --in-part--.
Line 7, after "continuation" insert --in-part--.

Signed and Sealed this

Twelfth Day of October 1976

[SEAL]

*Attest:*

RUTH C. MASON
*Attesting Officer*

C. MARSHALL DANN
*Commissioner of Patents and Trademarks*